US006332820B1

(12) United States Patent
Shimamura et al.

(10) Patent No.: US 6,332,820 B1
(45) Date of Patent: Dec. 25, 2001

(54) PLANAR DISPLAY DEVICE MANUFACTURING METHOD

(75) Inventors: Toshiki Shimamura; Kouji Inoue, both of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/484,229

(22) Filed: Jan. 18, 2000

(30) Foreign Application Priority Data

Jan. 20, 1999 (JP) ..... 11-012235

(51) Int. Cl.[7] ..... H01J 9/02

(52) U.S. Cl. ..... 445/24; 430/314; 430/319

(58) Field of Search ..... 445/24; 430/313, 430/314, 319

(56) References Cited

U.S. PATENT DOCUMENTS 5,763,139 * 6/1998 Matsunaga et al. ..... 445/24
6,045,426 * 4/2000 Wang et al. ..... 445/24
6,113,449 * 9/2000 Sung et al. ..... 445/24

* cited by examiner

*Primary Examiner*—Kenneth J. Ramsey
(74) *Attorney, Agent, or Firm*—Ronald P. Kananen; Rader, Fishman & Grauer PLLC

(57) ABSTRACT

To manufacture a field-emitting type cathode of a planar display device at a high accuracy, the following steps are included: the step of forming a first electrode (11) on a substrate (1) and a an electron emitting portion (9) on the electrode (11), forming an insulating layer (7) on an area including the first electrode (11) and electron emitting portion (9), and forming an electrode layer (121) serving as a second electrode on the insulating layer (7); the step of forming a negative type photoresist layer (30) on the entire surface including the electrode layer (121), exposing the photoresist layer (30) by using the electron emitting portion (9) as a mask and thereby applying ultraviolet radiation (31) from the back of the substrate (1), and selectively removing a photoresist layer (301) at a portion corresponding to the electron emitting portion (9) by developing the layer (30); and the step of forming an opening from which the electron emitting portion (9) is exposed by using the remaining photoresist layer (301) as a mask and thereby selectively etching the electrode layer (121) and insulating layer (7).

14 Claims, 9 Drawing Sheets

Test Pattern

Positive Type Photoresist Pattern

Negative Type Photoresist Pattern

Test Pattern

Positive Type Photoresist Pattern

Negative Type Photorsist Pattern

PLANAR DISPLAY DEVICE MANUFACTURING METHOD

BACKGROUND OF THE INVENTION

1. Field of the Invention

The present invention relates to a method for manufacturing a planar display device using the field electron emitting phenomenon.

2. Description of the Related Art

FIG. 1 is a perspective view showing a part of the cross section of a planar display device using the field electron emitting phenomenon having a typical configuration.

The planar display device 15 is constituted so that a first and second substrates 1 and 2 each comprising a glass substrate are facing each other through a reinforcement spacer 3 by keeping a certain interval from each other. Peripheries of these faced substrates 1 and 2 are airtightly sealed by, for example, a glass frit through an insulating outer-peripheral frame 14 made of ceramic or the like. An airtight flat space is formed between the both substrates 1 and 2, an electron emitting portion 4 is formed at the side of first substrate 1, and a fluorescent screen 5 is formed at the side of second substrate 2.

On the first substrate 1, for example, a plurality of first striped electrodes (so-called cathode electrodes) 11 and a plurality of second electrodes (so-called gate electrodes for taking out electrons) 12 are arranged in parallel in the direction to be intersected each other (e.g. to be intersected perpendicularly to each other) and intersections are electrically insulated from each other through an insulating layer 7.

Moreover, a field-emitting type cathode 4 is constituted correspondingly to each of the intersections between the first and second electrodes 11 and 12. These field-emitting type cathodes 4 respectively have a cold cathode configuration in which, an opening 8 passing through the insulating layer 7 and the upper second electrode 12 is formed at the intersection between the first and second electrodes 11 and 12 as shown in FIGS. 2A and 2B, and an electron emitting portion (so-called emitter) 9 is formed on the lower first electrode 11 in the opening 8. In this case, a plurality of electron emitting portions 9 are arranged for each pixel (for each sub-pixel because phosphors R, G, and B serving as three sub-pixels constitute one pixel in the case of a color fluorescent screen).

A metal back layer 6 made of a thin film conductive layer is formed on the fluorescent screen 5 at the second substrate 2 side and a high acceleration voltage is applied to the metal back layer 6.

Moreover, because a required voltage is applied between selected electrodes of the first and second electrodes 11 and 12, electrons are taken out from the electron emitting portions 9 of the field-emitting type cathodes 4 arranged at the intersections and accelerated by the above acceleration voltage, to pass through the metal back layer 6, and to impact the fluorescent screen 5, and thereby, the screen 5 is made to fluoresce, and a fluorescent display such as an image display is realized.

The above field-emitting type cathode is formed by the film forming process including spin coating, printing, vacuum evaporation, sputtering, and CVD (chemical vapor deposition) and the so-called photolithography process including etching using a photoresist mask and lift-off.

FIGS. 3 and 4 show the steps of manufacturing a field-emitting type cathode according to a prior art.

First, as shown in FIG. 3A, a striped first electrode 11 is formed on one plane of a first substrate 1, an electron emitting portion 9 is formed at the intersection with a second electrode 12 on the first electrode 11 through the lift-off method or selective etching, thereafter an insulating layer 7 is formed on the entire surface, and moreover a striped second electrode 12 intersecting with the first electrode 11 is formed on the insulating layer 7.

Then, a positive-type photoresist layer 17 is formed on the entire surface including the second electrode 12 and only the photoresist layer 17 at a portion corresponding to an electron emitting portion 9 is selectively exposed by applying ultraviolet radiation 19 through a photomask 18. Reference numeral 17*a* denotes a portion to be exposed and 17*b* denotes a portion to be unexposed. In this step, the position of the photomask 18 is adjusted on the basis of a previously-formed reference marker so that the center of the electron emitting portion 9 coincides with the center of the opening of the second electrode 12 to be thereafter formed.

Then, as shown in FIG. 3B, development is performed to remove the exposed portion 17*a* of the photoresist layer 17 and form the photoresist layer 17 on which an opening 20 is formed.

Then, as shown in FIG. 4A, the opening 8 is formed with selective etching by using the photoresist layer 17 as a mask so that the electron emitting portion 9 is exposed with the openings passing through the second electrode 12 and the insulating layer 7 below the second electrode 12.

Then, as shown in FIG. 4B, the photoresist layer 17 is removed to obtain the field-emitting type cathode 4 constituted by forming the electron emitting portion 9 in the opening 8 formed at the intersection between the first electrode 11 and the second electrode 12.

In the case of the above conventional method for manufacturing the field-emitting type cathode 4, a substrate 1 is deformed due to a film stress generated when the insulating layer 7 is formed through sputtering and CVD in the steps of FIG. 3A or a relative positional shift is produced between the opening-forming photomask 18 and the position of the electron emitting portion 9 due to expansion and contraction of the substrate 1 caused by heat treatment of glass paste relating to printing when forming the insulating layer 7. Therefore, as shown in FIG. 4B, when a positional shift is finally produced between the opening 8 of the second electrode 12 and the electron emitting portion 9, problems occur that the number of electrons to be emitted fluctuates and irregular display appears.

On the other hand, when decreasing the distance between the electron emitting portion 9 and the second electrode 12, an electron emitting voltage tends to become lower. When the electron emitting voltage lowers, a display circuit becomes inexpensive and a display device at a low power consumption is realized. Therefore, very fine patterning is requested.

However, most exposure systems for manufacturing a large planar display device of 20 inches type or more use the so-called proximity exposure in which the photomask 18 is exposed by separating it from the photoresist layer 17 by considering the damage of the photomask 18. Because the proximity exposure is of a method to form a gap between the photomask 18 and the photoresist layer 17, it is a problem that a deformed substrate cannot be corrected and thereby, a positional shift occurs.

Moreover, because a gap is present between the photomask 18 and the photoresist layer 17, a disadvantage occurs that a very fine pattern cannot be obtained.

In the field of manufacturing of a semiconductor device such as an LSI, a projection system is used as an exposure device for realizing very fine photolithography. However, the projection system is not realistic because an exposure system is very expensive and an exposure system for a planar display device of 20 inches type or larger is restricted in its optical system.

By applying the self-alignment method to the alignment between the opening 8 of the second electrode 12 and the electron emitting portion 9, the problem of positional shift due to deformation or expansion and contraction of a substrate, which generates when forming the insulating layer 7, is solved. Moreover, because the number of photomasks and the number of position adjusting steps for exposure are decreased by the self-alignment method, an inexpensive planar display device can be manufactured.

As an example of manufacturing a field-emitting type cathode using the self-alignment method, the spin vacuum-evaporation method (so-called SUPINTO method) developed by Mr. SUPINTO in US at the SRI (Stanford Research Institute) is known.

SUMMARY OF THE INVENTION

The present invention provides a method for manufacturing a planar display device making it possible to form a higher-accuracy field-emitting type cathode in view of the above described points.

A planar display device manufacturing method of the present invention forms the positional relation between an electron emitting portion and a second electrode opening in a self-alignment manner through photolithography and back exposure using a cathode constituting material having opaqueness as a mask in the step of manufacturing a field-emitting type cathode.

In the case of the manufacturing method, a second-electrode opening corresponding to an electron emitting portion is formed through photolithography and back exposure from the substrate side by using a cathode constituting material such as an electron emitting portion or an electrode layer having an opening and serving as a second electrode as a mask. The positional relation between the electron emitting portion and the second electrode opening is determined in a self-alignment manner.

DETAILED DESCRIPTION OF THE PREFERRED EMBODIMENT

A method for manufacturing a planar display device of the present invention comprises the step of forming a first electrode on the surface of a substrate and an electron emitting portion on the first electrode, forming an insulating layer on an area including the first electrode and the electron emitting portion, and forming an electrode layer serving as a second electrode on the insulating layer; the step of forming a negative type photoresist layer on the entire surface including the electrode layer, exposing the photoresist layer from the back of the substrate by using the electron emitting portion as a mask, and selectively removing the photoresist layer at a portion corresponding to the electron emitting portion by developing the photoresist layer; and the step of selectively etching the electrode layer and insulating layer by using the remaining photoresist layer as a mask and forming an opening from which the electron emitting portion is exposed.

A method for manufacturing a planar display device of the present invention comprises the step of superposing a first electrode, an insulating layer, and an electrode layer serving as a second electrode on the surface of a substrate and forming an opening from which the first electrode is exposed at predetermined positions of the electrode layer and insulating layer; the step of forming a positive type photoresist layer in the opening and on the electrode layer, exposing the photoresist layer from the back of the substrate by using the electrode layer as a mask, and removing the photoresist layer out of the opening by developing the photoresist layer; the step of attaching an electron emitting material to the inside of the opening and the surface of the photoresist layer; the step of lifting off the photoresist layer and the electron emitting material on the photoresist layer and forming an electron emitting portion on the first electrode in the opening; and the step of patterning the electrode layer and forming a second electrode intersecting with the first electrode and having the opening at the intersection.

Embodiments of the present invention are described below by referring to the accompanying drawings. However, the present invention is not restricted to the embodiments.

FIGS. 5 and 6 are manufacturing process charts showing an embodiment of the present invention.

Figure 5A:
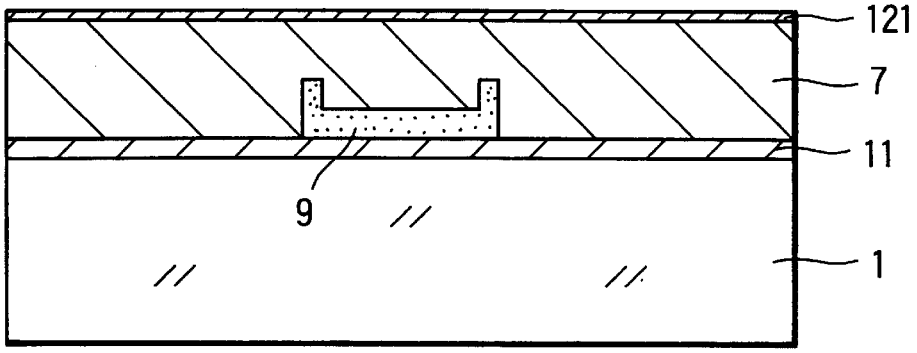
FIGS. 5A to 5C are process charts showing an embodiment of a method for manufacturing a planar display device of the present invention, particularly a method of manufacturing a field-emitting type cathode of the device.

In the case of this embodiment, a first substrate 1 constituted of, for example, a glass substrate is first prepared as shown in FIG. 5A. The glass substrate uses a glass substrate such as white plate glass (B-270 SCHOTT), blue plate glass (soda lime), or no-alkali glass (OA2 made by NIPPON DENKI GARASU) through which ultraviolet radiation for exposure can pass.

On one plane of the first substrate 1, a plurality of striped first electrodes (so-called cathode electrodes) 11 are formed so as to be arranged in parallel and an electrode emitting portion (so-called emitter) 9 made of an electron emitting material is formed at a position corresponding to the intersection between a second electrode 12 to be described later and each of the first electrodes 11 by, for example a, lift-off method or a selective etching method. The electron emitting portion 9 can be formed like a crown whose periphery sharply protrudes upward as illustrated.

Then, an insulating layer 7 is formed on an area including the electron emitting portion 9 and first electrodes 11 and moreover, a plurality of striped substrate electrode layers 121 respectively serving as the substrate of a second electrode (so-called gate electrode for taking out electrons) are formed on the insulating layer 7 so that they perpendicularly intersect with the first electrodes 11 and arranged in parallel.

Each first electrode 11 is made of a material through which ultraviolet radiation for exposure can pass, that is, the electrode 11 uses a transparent electrode material such as ITO.

The insulating layer 7 is also made of a material through which ultraviolet radiation for exposure can pass.

The substrate electrode layer 121 of the second electrode is a substrate for electrodeposition-forming a second electrode material in the subsequent process, which can be formed of a material through which ultraviolet radiation for exposure can pass, for example, transparent electrode material such as ITO or a very thin metal, that is, a metal having a thickness through which ultraviolet radiation for exposure can pass such as Cr or Ti.

The electron emitting portion 9 is formed of a metal such as Mo, W, or Ni or a carbon-based material at a thickness capable of shielding ultraviolet radiation for exposure.

It is also permitted to form the insulating layer 7 on the entire surface including the first electrodes 11 and the electron emitting portion 9 or only on the substrate electrode layer 121 like a stripe.

Figure 5B:
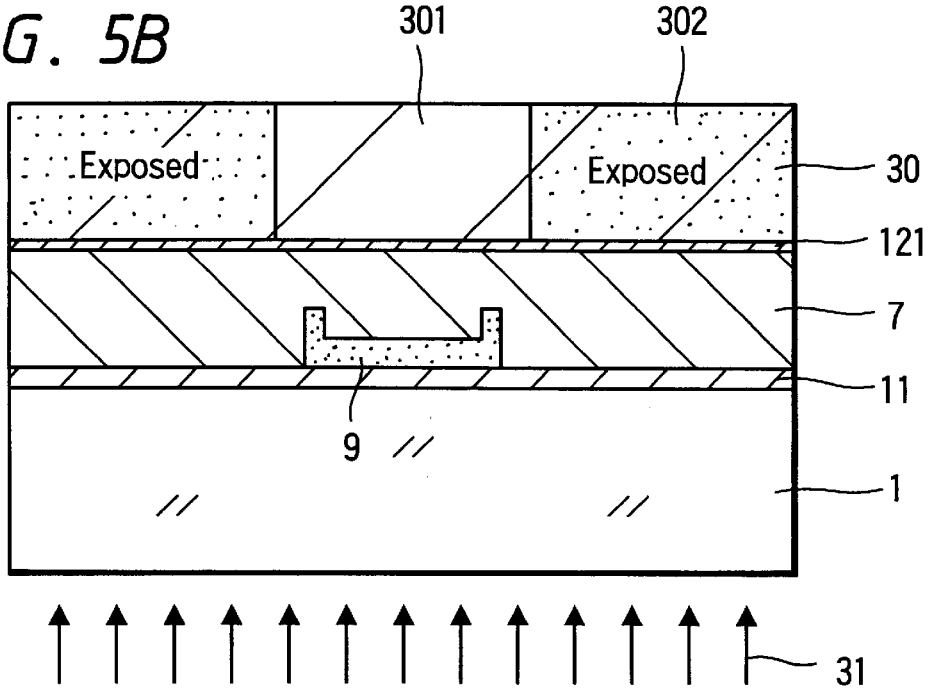

Then, as shown in FIG. 5B, a negative type photoresist layer 30 is attached to the entire surface including the substrate electrode layer 121 to expose the layer 30 by applying ultraviolet radiation 31 from the back of the first substrate 1. Since during the back exposure, the electron emitting portion 9 serves as a photomask for shielding the ultraviolet radiation 31, a photoresist layer 301 in an area corresponding to the electron emitting portion 9 is not exposed (portion to be unexposed) but a photoresist layer 302 in other areas is exposed (portion to be exposed).

Figure 5C:
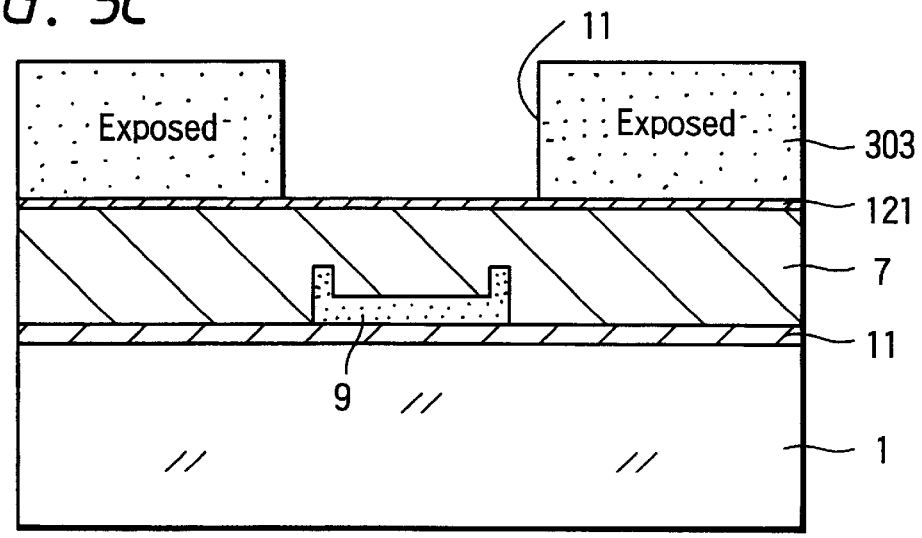

Then, as shown in FIG. 5C, the unexposed area 301 of the photoresist layer 30 is removed by developing and eluting the area 301 to form a resist mask 303 having an opening 303*a* at a portion corresponding to the electron emitting portion 9.

Figure 6A:
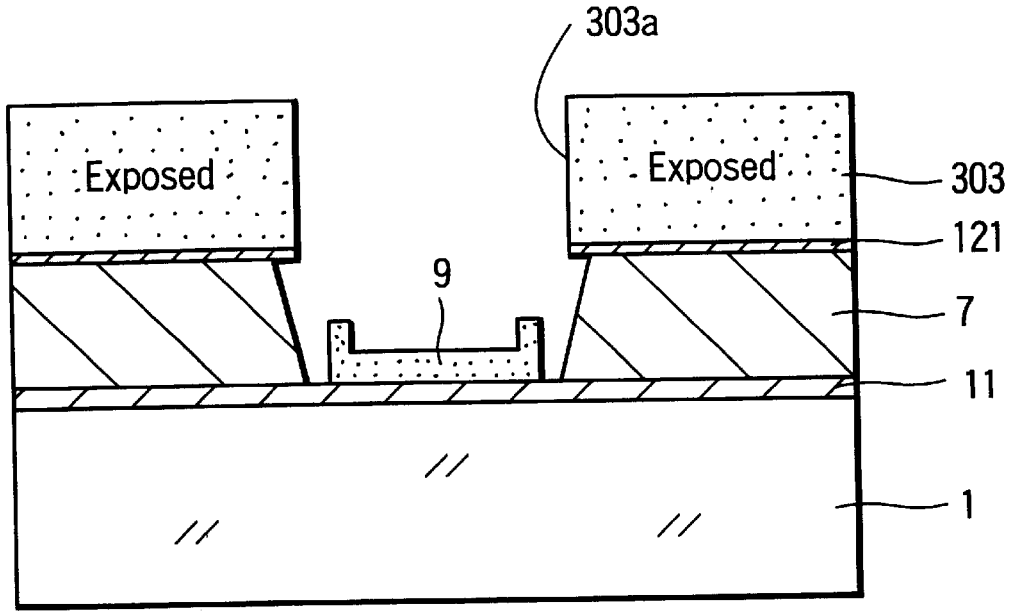
FIGS. 6A and 6B are process charts showing an embodiment of method for manufacturing a planar display device of the present invention, particularly a method of manufacturing a field-emitting type cathode of the device.

Then, as shown in FIG. 6A, the substrate electrode layer 121 and the insulating layer 7 below the layer 121 are selectively etched and removed through the resist mask 303 until the electron emitting portion 9 is exposed to form an opening 8 from which the electron emitting portion 9 is exposed.

Figure 6B:
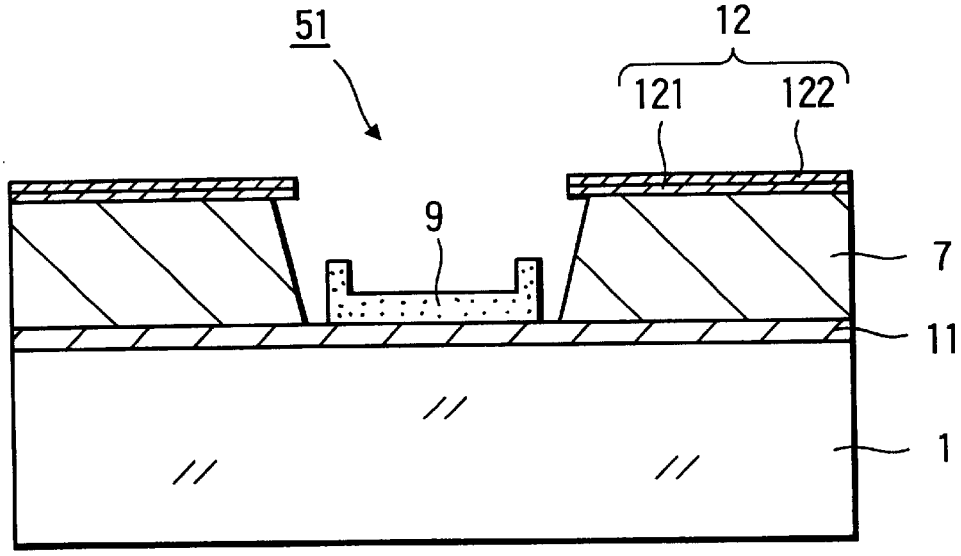

Then, as shown in FIG. 6B, after removing the resist mask 303, a metallic film made of Cu or the like is selectively formed on the substrate electrode layer 121 through electrodeposition or the like to form a second electrode (a so-called "gate electrode") 12 using the metallic electrode layer 122 and substrate electrode layer 121. Thereby, a field-emitting type cathode 51 is obtained.

Figure 1:
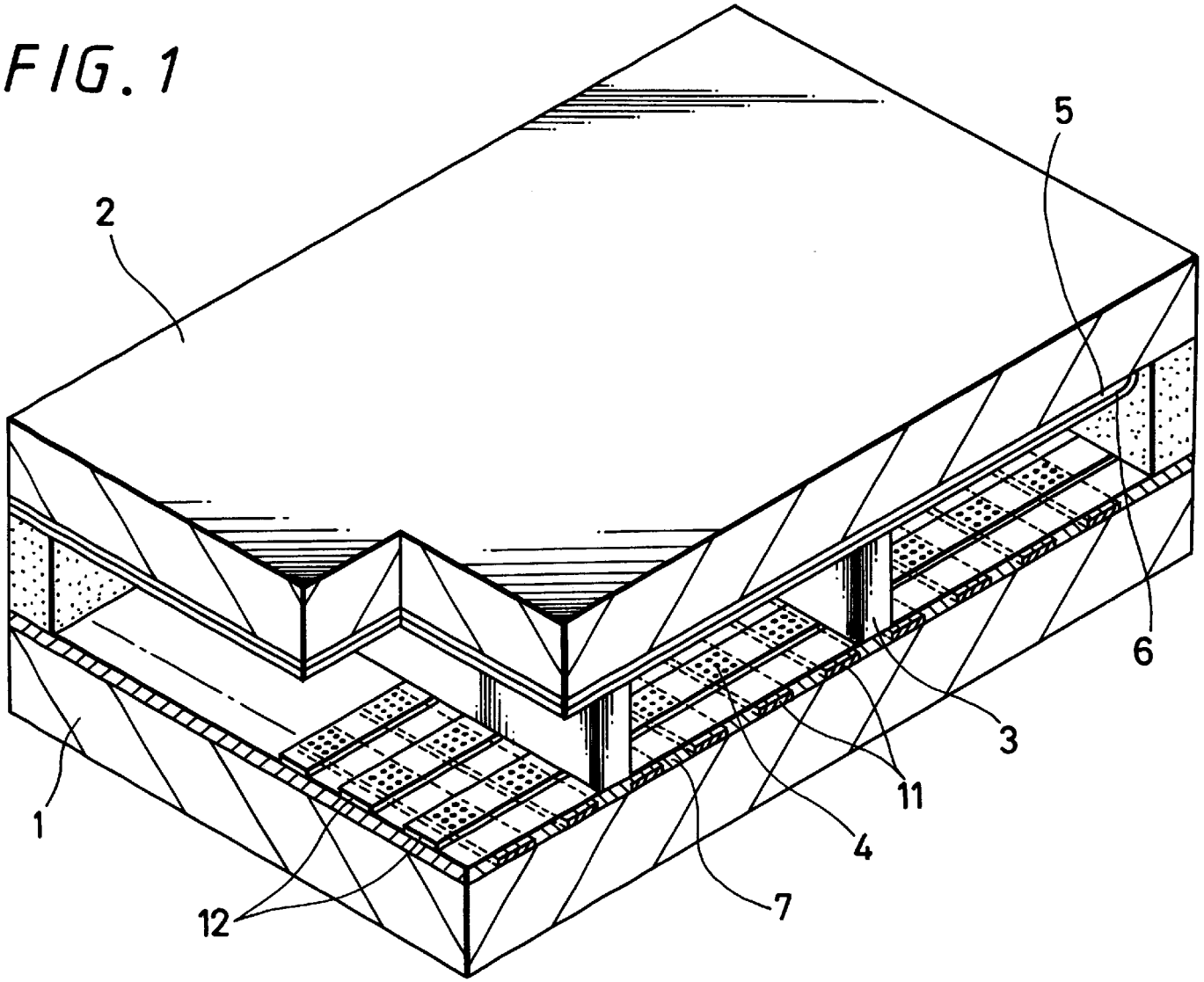
FIG. 1 is a perspective view of a planar display device using a field emitting phenomenon, locally showing the cross section of the device.
Figure 2A:
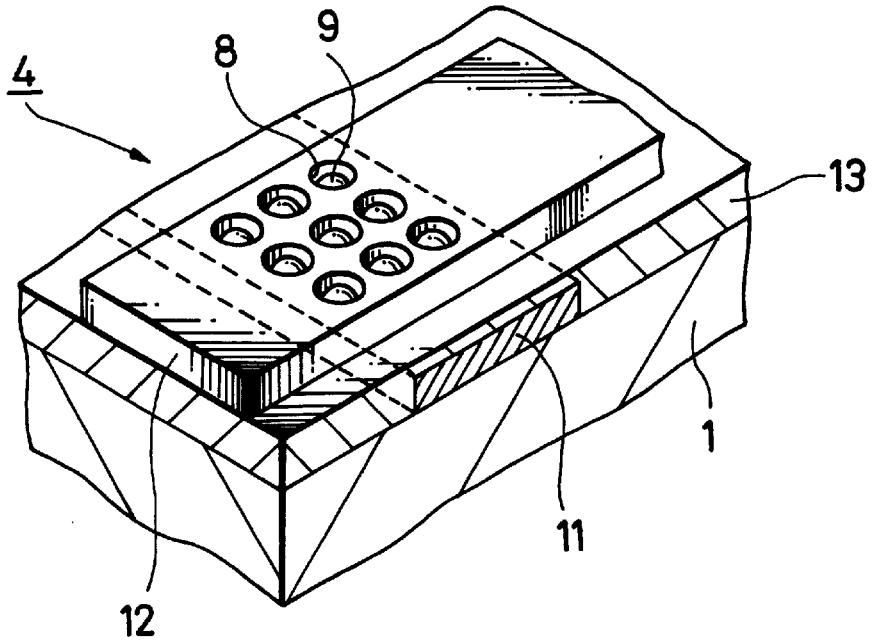
FIG. 2A is a perspective view of an essential portion of the field-emitting type cathode of the planar display device in FIG. 1
Figure 2B:
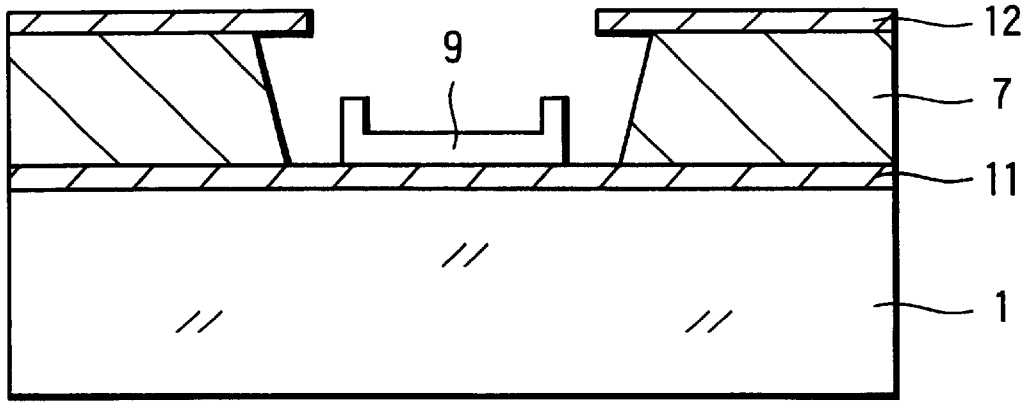
FIG. 2B is a sectional view of the essential portion in FIG. 2A.
Figure 3A:
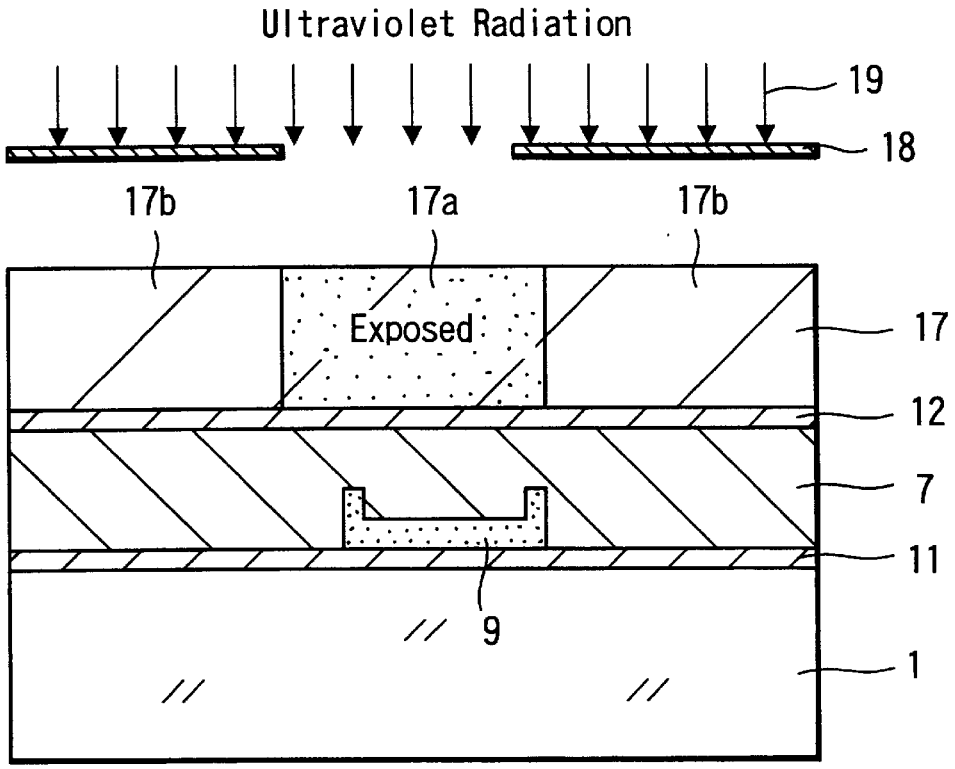
FIGS. 3A and 3B are process charts of a conventional field-emitting-cathode manufacturing method.
Figure 3B:
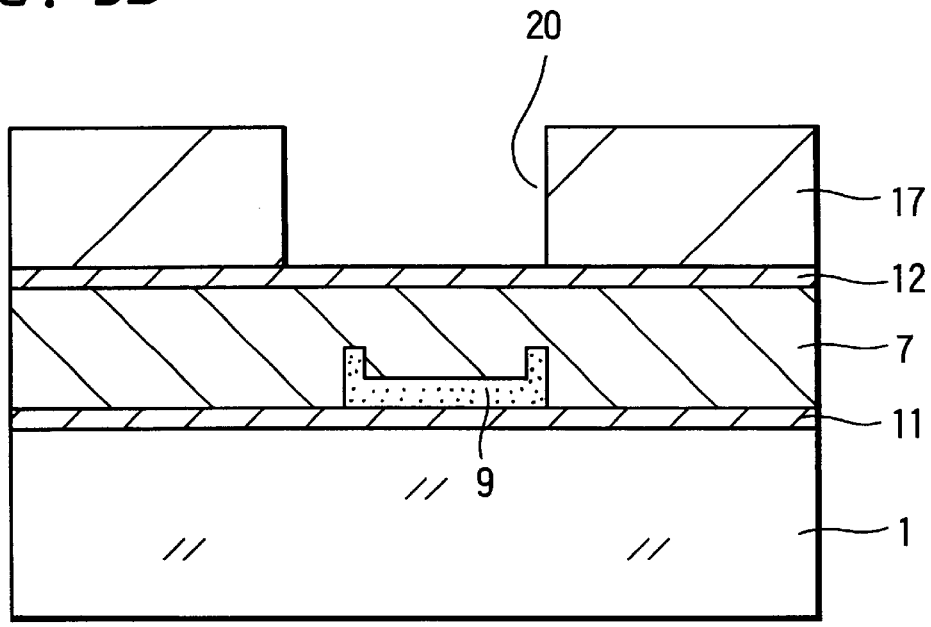
Figure 4A:
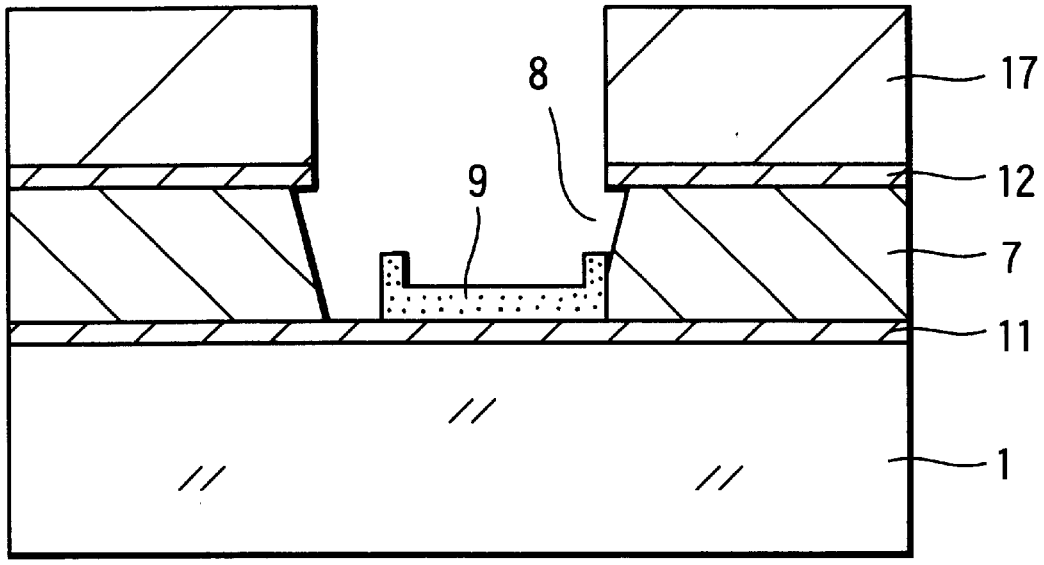
FIGS. 4A and 4B are process charts of a conventional field-emitting-cathode manufacturing method.
Figure 4B:
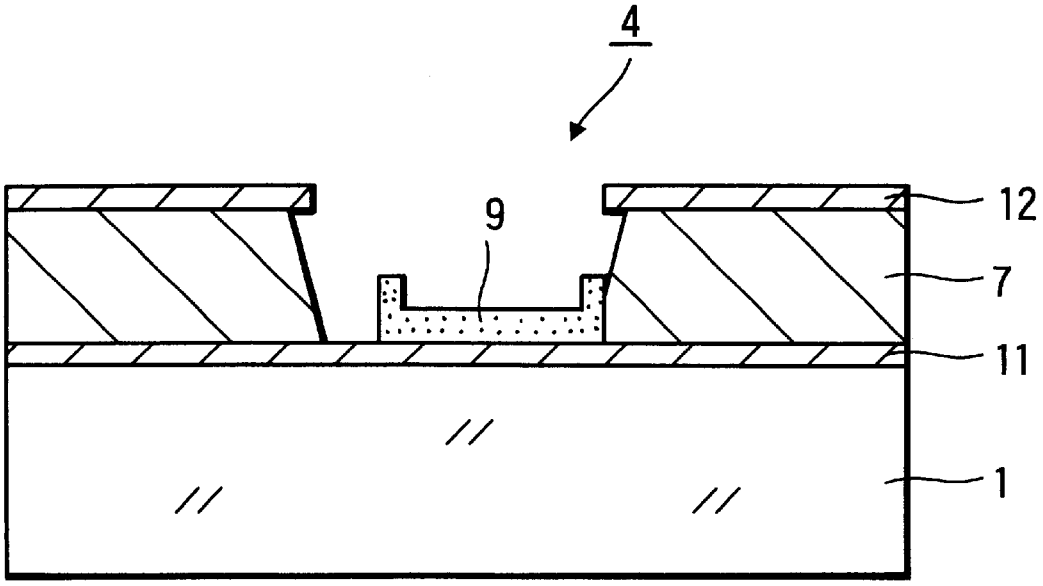

Hereafter, though not illustrated, a fluorescent screen 5 is formed on one plane of a second substrate 2 constituted of, for example, a glass substrate similarly to the case of FIG. 1, moreover a metal back layer 6 is formed on the fluorescent screen 5, and thereafter the second substrate 2 is superposed on the first substrate 1 on which the field-emitting type cathode 51 is formed through a spacer 3, the flat space formed between the both substrates 1 and 2 is brought into a vacuum state, and the periphery is airtightly sealed by, for example, a glass frit through an outer-peripheral frame 14 to obtain a final planar display device.

According to a method for manufacturing a planar display device of the present invention, particularly a method of manufacturing the field-emitting type cathode 51 of the planar display device, the first electrode 11, electron emitting portion 9, insulating layer 7, and substrate electrode layer 121 of the second electrode are superimposed in order and then, the negative type photoresist layer 30 is formed on the entire surface in the step in FIG. 5B to form the opaque electron emitting portion 9 through photolithography according to back exposure from the side of substrate 1 by using the opaque electron emitting portion 9 as a photomask. Therefore, the positional relation between the opening 8 and the electron emitting portion 9 is accurately determined through self-alignment. Therefore, in the case of a planar display device, display irregularity due to the positional shift between the opening 8 and the electron emitting portion 9 caused by deformation or expansion and contraction of the substrate 1 when forming the insulating layer 7 is prevented.

Because the number of photomasks is decreased and moreover, the number of position adjusting steps is decreased by the self-alignment method using back exposure, the manufacturing cost is reduced and thereby, it is possible to provide an inexpensive planar display device.

In the case of the photolithography through back exposure, high-accuracy patterning is realized compared to the case of proximity exposure because the distance between the mask 9 (that is the, electron emitting portion) and the photoresist layer 30 is small. It is possible to decrease the distance between the electron emitting portion 4 and the second electrode 12 through high-accuracy patterning and lower an electron emitting voltage. When the electron emitting voltage lowers, a display circuit becomes inexpensive. Therefore, it is possible to manufacture an inexpensive planar display device requiring less power consumption.

FIGS. 7 and 8 are manufacturing process charts showing another embodiment of the present invention.

Figure 7A:
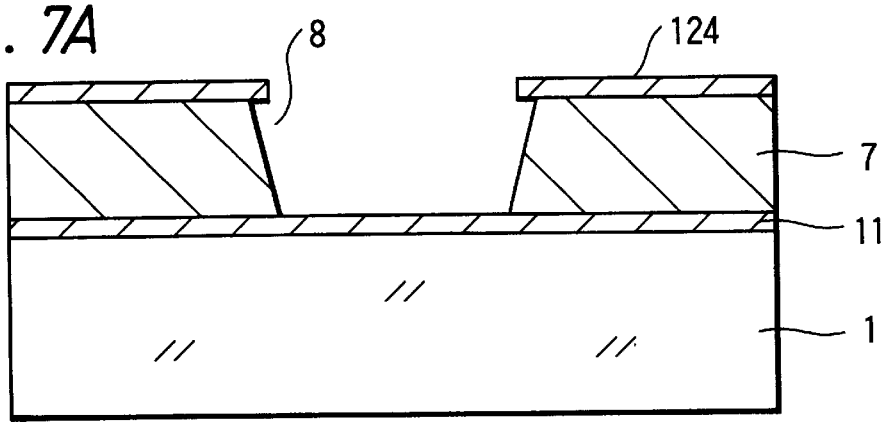
FIGS. 7A to 7C are process charts showing another embodiment of a method for manufacturing a planar display device of the present invention, particularly a method of manufacturing an field-emitting type cathode of the device.

In the case of this embodiment, as shown in FIG. 7A, a plurality of striped first electrodes (so-called cathode electrodes) 11 are formed on one plane of a first substrate 1 so as to be arranged in parallel and moreover an electrode layer 124 serving as a second electrode (so-called gate electrode for taking out electrons) is formed over the entire surface through an insulating layer 7 so as to be electrically separated from the first electrodes 11. Thereafter an opening 8 is formed at a portion corresponding to the intersection between the first electrode 11 and a second electrode 12 to be described later so that the first electrode 11 is exposed with the opening passing through the electrode layer 124 and the insulating layer 7 by the normal photolithography step and etching step. The insulating layer 7 is formed on the entire surface including the surface of the first electrode 11.

In this case, as the first substrate 1 can be used a glass substrate made of white plate glass, blue plate glass, or no-alkali glass through which ultraviolet radiation for exposure can pass in the subsequent steps similarly to the above describe.

The first electrode 11 is made of a material through which ultraviolet radiation for exposure can pass and for example, a transparent electrode material such as ITO can be used.

It is also possible to form the insulating layer 7 of any material through which ultraviolet radiation for exposure can or cannot pass.

The electrode layer 124 serving as a second electrode is made of a material capable of shielding ultraviolet radiation for exposure. It is possible to form the electrode layer 124 of metals such as Cr, Ti, Au (upper layer)/Cu (lower layer), Au (upper layer), Ti (lower layer) at a thickness capable of shielding ultraviolet radiation for exposure.

Figure 7B:
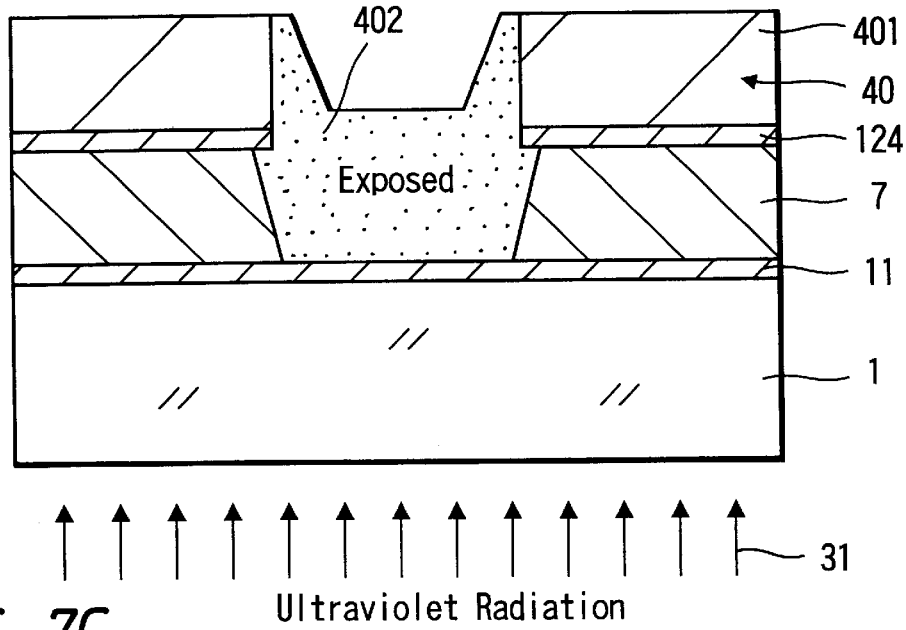

Then, as shown in FIG. 7B, a positive type photoresist layer 40 is formed on the entire surface including the inside of the opening 8 and exposed by applying ultraviolet radiation 31 from the back of the first substrate 1. During the back exposure, the electrode layer 124 becomes a photomask to shield ultraviolet radiation 31. A photoresist layer 401 in an area corresponding to the surface of the electrode layer 124 is not exposed (portion to be unexposed) but only a photoresist layer 402 in an area in the opening 8 is exposed (portion to be exposed).

Figure 7C:
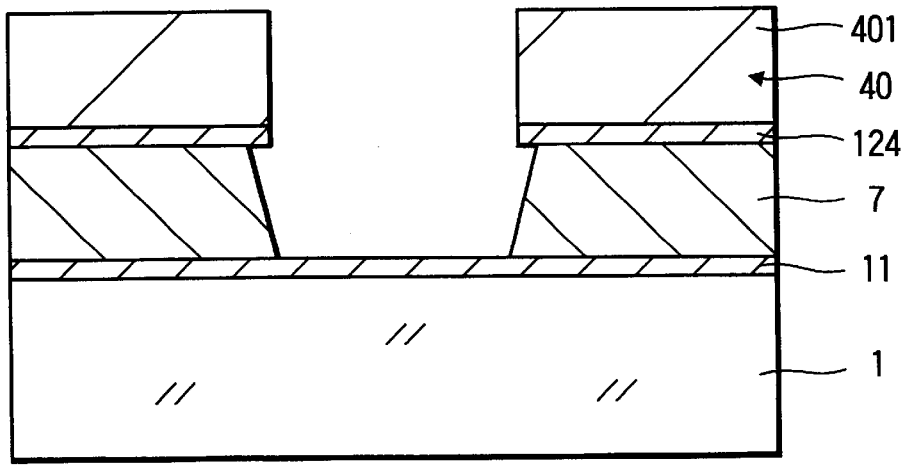

Then, as shown in FIG. 7C, only the exposed photoresist layer 402 in the opening 8 is eluted and removed through development to make the opening 8 from which the lower first electrode 11 is exposed appear.

Figure 8A:
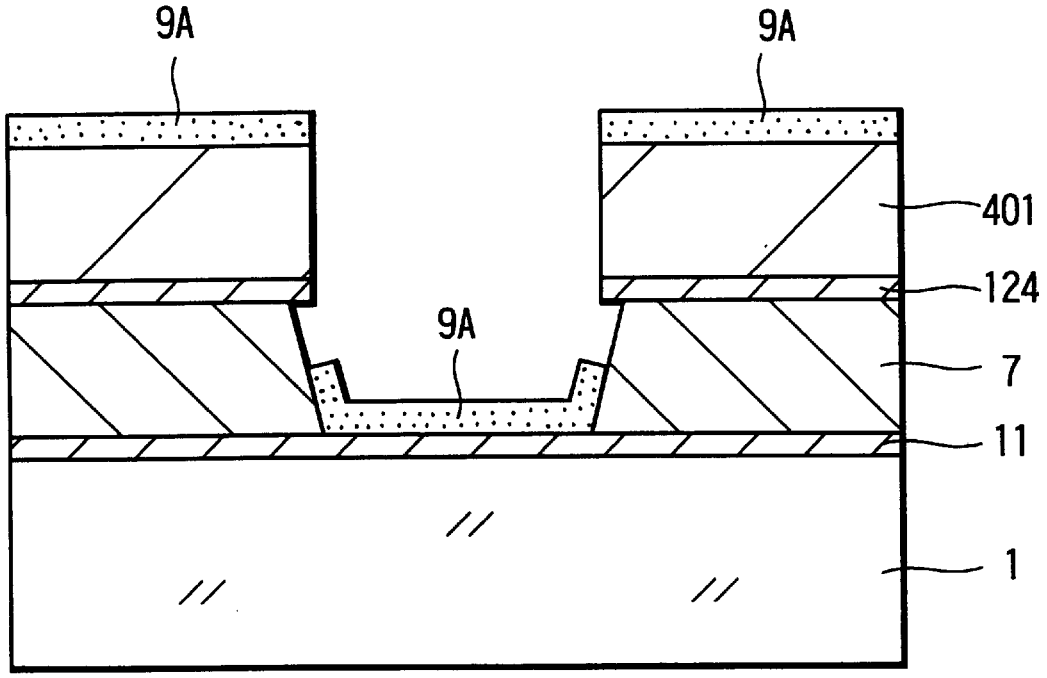
FIGS. 8A and 8B are process charts showing another embodiment of a method for manufacturing a planar display device of the present invention, particularly a manufacturing method of a field-emitting type cathode of the device

Then, as shown in FIG. 8A, an electron emitting material 9A made of a metal such as Mo, W, or Ni or a carbon-based material is formed on the entire surface including the inside of the opening 8 while the unexposed photoresist layer 401 other than the opening 8 is left by means of spin coating, vapor deposition, or sputtering.

Figure 8B:
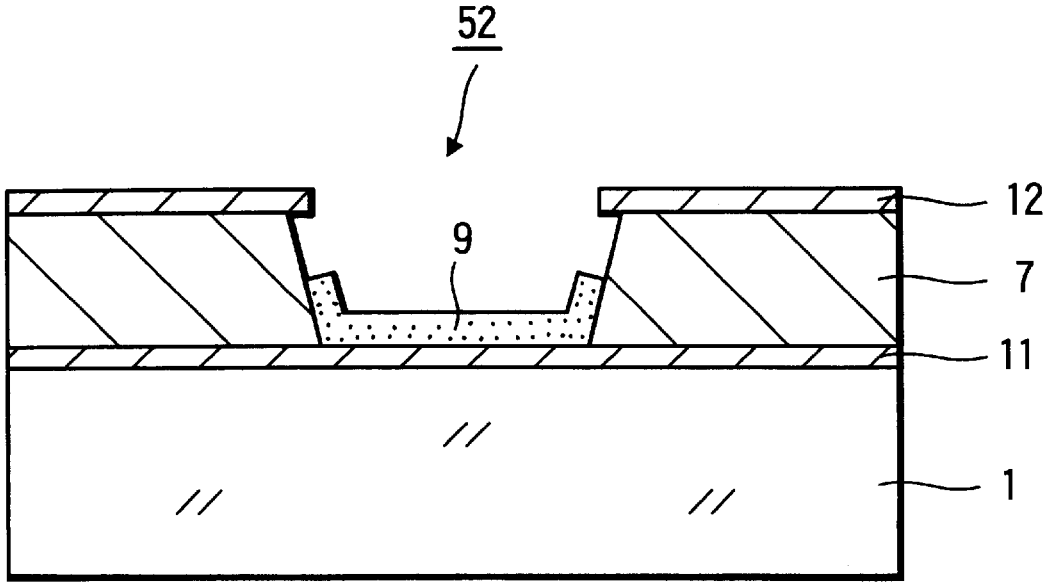

Then, the photoresist layer 401 is removed and unnecessary electron emitting material 9A on the layer 401 is lifted off to form an electron emitting portion 9 made of the electron emitting material 9A on the first electrode 11 in the opening 8. Then, the electrode layer 124 is patterned through the normal photolithography and etching steps to form a plurality of striped second electrodes 12 intersecting with, for example, perpendicularly intersecting with the first electrode 11 and respectively having the opening 8 at the intersection. Thereby, the field-emitting type cathode 52 shown in FIG. 8B is obtained.

Hereafter, though not illustrated, similarly to the case of FIG. 1, a fluorescent screen 5 is formed on one plane of a second substrate 2 constituted of, for example, a glass substrate and moreover, a metal back layer 6 is formed, and thereafter the second substrate 2 is superposed on the first substrate 1 with the field-emitting type cathode 52 formed through a spacer 3, the flat space formed between the both substrates 1 and 2 is brought into a vacuum state and the periphery is airtightly sealed by a glass frit through an outer-peripheral frame 14 to obtain a final planar display device.

According to manufacturing a method for a planar display device manufacturing of this embodiment, particularly a method of manufacturing the field-emitting type cathode of the display device, the first electrode 11, insulating layer 7, and electrode layer 124 serving as a second electrode are formed on the surface of the first substrate 1, the opening 8 passing through the electrode layer 124, and an insulating layer 7 is formed at a predetermined position corresponding to the intersection between the first and second electrodes 11 and 12. Then, the positive type photoresist layer 40 is formed on the entire surface including the opening 8 in the steps B and C in FIG. 7. The photoresist layer 401 is left in the area except the opening 8 through the photolithography according to back exposure from the side of substrate 1 and the electron emitting film 9A is attached and lifted off in the steps 8A and 8B in FIG. 8 under this state to form the electron emitting portion 9 in the opening 8. Therefore, the positional relation between the opening 8 and electron emitting portion 9 is accurately determined through self-alignment.

Therefore, in the case of the planar display device, display irregularity due to the positional shift between the opening 8 and the electron emitting portion 9 caused by deformation or expansion and contraction of the substrate 1 when forming the insulating layer 7 is solved.

Moreover, similarly to the case of the embodiment in FIGS. 5 and 6, it is possible to decrease the number of photomasks and reduce the manufacturing cost because the number of position adjusting steps under exposure is decreased.

Furthermore, the same advantages as those of the first embodiment can be obtained because a high accuracy patterning can be realized because the distance between the mask (electrode layer 124 serving as the second electrode 12) and the photoresist layer 40 is substantially absent, the distance between the electron emitting portion 9 and the second electrode 12 can be decreased because of a high-accuracy patterning and an electron emitting voltage can be lowered, and the cost of a display circuit can be reduced.

Furthermore, it is possible to manufacture a low power consumption and inexpensive planar display device.

Then, results of observing a positive type photoresist pattern and a negative type photoresist pattern formed through back exposure by using a test pattern (equivalent to a mask) made of a Cr film formed on a glass substrate are described below.

Figure 9A:
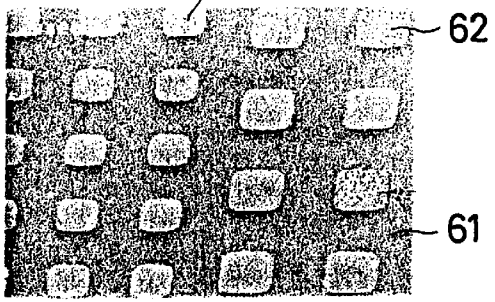
FIGS. 9A to 9F are illustrations showing a test pattern using a Cr film and negative type and positive type photoresist patterns formed through back exposure by using the test pattern.

FIG. 9A (SEM photograph) shows a Cr-film test pattern 62 (Cr-film thickness: 0.2 μm) of 5 μm□ and 4 μm□ formed on a glass substrate 61.

Figure 9B:
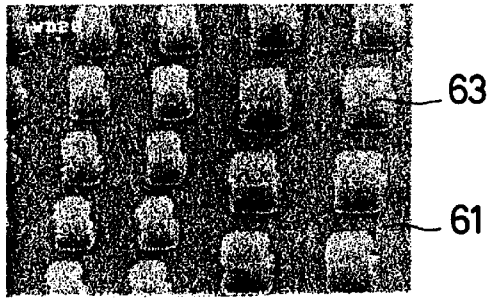

FIG. 9B (SEM photograph) shows a positive type photoresist pattern 63 after being back-exposed and developed by using the Cr-film test pattern 62 in FIG. 9A. The positive type photoresist used is AZP4400 made by KURARIANTO (transliterated) JAPAN having a film thickness of 3.6 μm.

Figure 9C:
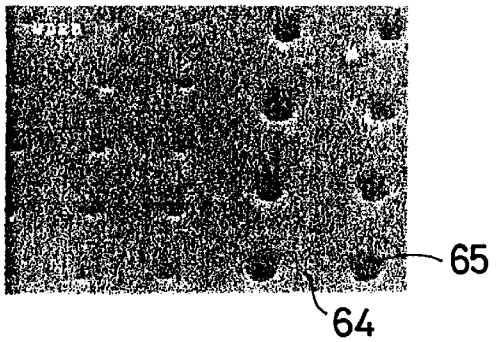

FIG. 9C (SEM photograph) shows a negative type photoresist pattern 64 after being back exposed and developed by using the Cr-film test pattern 62 in FIG. 9A. Reference numeral 65 denotes an opening. The negative type photoresist used is ZPN1100 made by Nippon Zeon Co., Ltd. having a film thickness of 2.5 μm.

Figure 9D:
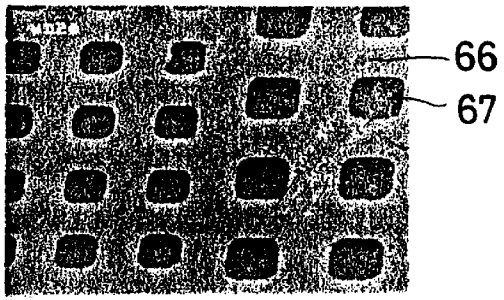

FIG. 9D (SEM photograph) shows a Cr-film test pattern 66 (reverse pattern of FIG. 9A) having openings 67 of 5 μm= and 4 μm□.

Figure 9E:
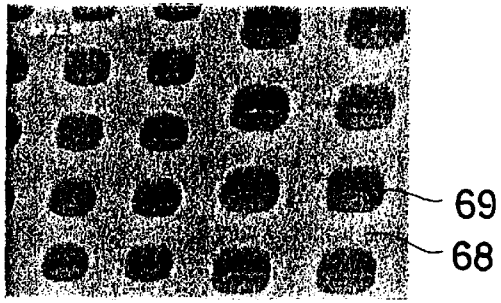
Figure 9F:
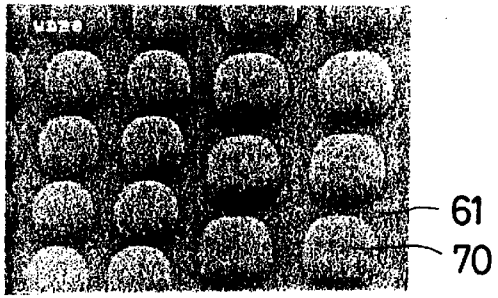

FIG. 9E (SEM photograph) shows a positive type photoresist pattern 68 after being back exposed and developed by using the Cr-film test pattern 66 in FIG. 9D. Reference numeral 69 denotes an opening. The positive type photoresist used is AZP4400 made by KURARIANTO (transliterated) JAPAN having a film thickness of 3.6 μm.

FIG. 9G (SEM photograph) shows a negative type photoresist pattern 70 after back exposed and developed by using the Cr-film test pattern 66 in FIG. 9D. The negative type photoresist used is ZPN1100 made by Nippon Zeon Co., Ltd. having a film thickness of 2.5 μm.

In the case of the positive type photoresist, it is shown that the Cr-film test patterns of 62 and 66 4 μm□ and 5 μm□ are transferred at a high accuracy. The negative type photoresist seems to have a resolution slightly lower than that of the positive type photoresist, in which an opening pattern of 4 μm□ is not removed. However, it is shown that the resolution is very high compared to the case of proximity exposure.

According to a method for manufacturing a planar display device of the present invention, particularly a method of manufacturing the field-emitting type cathode of the device, it is possible to prevent display irregularity from occurring due to a positional shift caused by deformation or expansion and contraction of a substrate when forming an insulating layer by using back exposure and thereby applying the self-alignment method to alignment of an opening formed on a second electrode and the insulating layer below the second electrode with an electron emitting portion.

Because the self-alignment method decreases the number of photomasks and the number of position adjusting steps for exposure, it is possible to reduce the manufacturing cost and realize an inexpensive planar display device.

The photolithography according to back exposure realizes high-accuracy patterning compared to the case of proximity exposure because the distance between a mask (corresponding to an electron emitting portion or second electrode) and a photoresist layer is small. That is, high-accuracy patterning makes it possible to decrease the distance between an electron emitting portion and a second eletrode and thereby, inexpensively manufacture a display circuit. Moreover, it is possible to provide a low-power-consumption and inexpensive display device.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A method for manufacturing a planar display device comprising the steps of:

forming a first electrode and an electron emitting portion on said first electrode on a surface of a substrate, forming an insulating layer on an area including said first electrode and said electron emitting portion, and forming an electrode layer serving as a second electrode on said insulating layer;

forming a negative type photoresist layer on the entire surface including said electrode layer, exposing said photoresist layer from the back of the substrate by using said electron emitting portion as a mask, and selectively removing said photoresist layer at a portion corresponding to said electron emitting portion by developing said photoresist layer; and selectively etching said electrode layer and the insulating layer by using said remaining photoresist layer as a mask.

2. A method for manufacturing a planar display device comprising the steps of:

superposing a first electrode, an insulating layer, and an electrode layer serving as a second electrode on a surface of a substrate and forming an opening from which said first electrode is exposed at predetermined positions of said electrode layer and insulating layer;

forming a positive type photoresist layer in said opening and on the electrode layer, exposing said photoresist layer from the back of the substrate by using said electrode layer as a mask, and removing said photoresist layer out of said opening by developing said photoresist layer;

attaching an electron emitting material to the inside of said opening and the surface of said photoresist layer;

lifting off said photoresist layer and said electron emitting material on said photoresist layer and forming an electron emitting portion on said first electrode in said opening; and patterning said electrode layer and forming a second electrode intersecting with said first electrode and having said opening at the intersection.

3. The method for manufacturing a planar display device as set forth in claim 1, wherein the substrate is a glass through which an ultraviolet radiation for exposure can pass.

4. The method for manufacturing a planar display device as set forth in claim 1, wherein said emitting portion is formed at an intersection between said first electrode and said second electrode.

5. The method for manufacturing a planar display device as set forth in claim 1, wherein said first electrode is made of a material through which ultraviolet radiation for exposure can pass.

6. The method for manufacturing a planar display device as set forth in claim 1, wherein said insulating layer is made of a material through which ultraviolet radiation for exposure can pass.

7. The method for manufacturing a planar display device as set forth in claim 1 further including a step of forming a plurality of striped substrate electrode layers serving as a substrate for the second electrode.

8. The method for manufacturing a planar display device as set forth in claim 7, wherein said first electrode and said second electrode are formed as a plurality of said first and said second electrodes.

9. The method for manufacturing a planar display device as set forth in claim 2, wherein the substrate is a glass through which an ultraviolet radiation for exposure can pass.

10. The method for manufacturing a planar type device as set forth in claim 2, wherein said emitting portion is formed at an intersection between said first electrode and said second electrode.

11. The method for manufacturing a planar type device as set forth in claim 2, wherein said first electrode is made of a material through which ultraviolet radiation for exposure can pass.

12. The method for manufacturing a planar type device as set forth in claim 2, wherein said insulating layer is made of a material through which ultraviolet radiation for exposure can pass.

13. The method for manufacturing a planar type device as set forth in claim 2, further including a step of forming a plurality of striped substrate electrode layers serving as a substrate for the second electrode.

14. The method for manufacturing a planar display device as set forth in claim 13, wherein said first electrode and said second electrode are formed as a plurality of said first and said second electrodes.

* * * * *

UNITED STATES PATENT AND TRADEMARK OFFICE

CERTIFICATE OF CORRECTION

PATENT NO. : 6,332,820 B1
DATED : December 25, 2001
INVENTOR(S) : Toshiki Shimamura and Kouji Inoue It is certified that error appears in the above-identified patent and that said Letters Patent is hereby corrected as shown below:

Title page,
Item [57], ABSTRACT, line 4, delete "a".

Signed and Sealed this

Twenty-third Day of April, 2002

*Attest:*

*Attesting Officer*

JAMES E. ROGAN
*Director of the United States Patent and Trademark Office*